US006634516B2

(12) United States Patent
Carballido

(10) Patent No.: US 6,634,516 B2
(45) Date of Patent: Oct. 21, 2003

(54) COLOR CHANGING CLOSURE FOR BOTTLING APPLICATIONS

(75) Inventor: Jose Luis Martinez Carballido, Monterrey (MX)

(73) Assignee: Fabricas Monterrey, S.A. de C.V., Monterrey (MX)

( * ) Notice: Subject to any disclaimer, the term of this patent is extended or adjusted under 35 U.S.C. 154(b) by 0 days.

(21) Appl. No.: 10/036,367

(22) Filed: Jan. 7, 2002

(65) Prior Publication Data

US 2003/0127415 A1 Jul. 10, 2003

(51) Int. Cl.[7] ..... B65D 41/00; B65D 85/00; G01D 21/00

(52) U.S. Cl. ..... 215/230; 374/150; 374/162; 374/208; 206/459.1; 116/207; 116/216

(58) Field of Search ..... 215/230; 206/459.1; 116/216, 206; 436/1, 2, 164; 422/58, 61; 73/61.46, 61; 426/118, 231; 374/150, 162, 208

(56) References Cited

U.S. PATENT DOCUMENTS

| | | | | |
|---|---|---|---|---|
| 3,257,021 A | | 6/1966 | Brockett | |
| 3,581,690 A | | 6/1971 | Zapata | |
| 4,310,100 A | | 1/1982 | Kunimoto et al. | |
| 4,957,949 A | | 9/1990 | Kamada et al. | |
| 5,091,006 A | | 2/1992 | Sarada et al. | |
| 5,217,646 A | | 6/1993 | McFarland | |
| 5,221,288 A | | 6/1993 | Kamata et al. | |
| 5,585,425 A | * | 12/1996 | Kito et al. | 428/184 |
| 5,720,555 A | * | 2/1998 | Elele | 524/324 |
| 6,139,779 A | | 10/2000 | Small et al. | |
| 6,183,827 B1 | | 2/2001 | Folchini et al. | |
| 2002/0022280 A1 | * | 2/2002 | Martin | 438/4 |
| 2002/0167989 A1 | | 11/2002 | Russo | |

* cited by examiner

*Primary Examiner*—Nathan J. Newhouse
*Assistant Examiner*—James Smalley
(74) *Attorney, Agent, or Firm*—Oblon, Spivak, McClelland, Maier & Neustadt, P.C.

(57) ABSTRACT

One embodiment of the present invention provides a metallic closure, which includes:

a metallic shell; and a thermochromic ink layer on a surface of the shell.

19 Claims, 1 Drawing Sheet

COLOR CHANGING CLOSURE FOR BOTTLING APPLICATIONS

BACKGROUND OF THE INVENTION

1. Field fo the Invention

The present invention relates to a metallic and preferably metallic crown closure that includes a metal closure shell and an interior sealing. The closure shell is covered with internal and external coatings and thermochromic inks, dyes or pigments that change color as the temperature changes. This closure preferably changes its color in a temperature range from 0 to 60° C.

2. Discussion of the Background

Crown caps are metallic closures for glass or plastic containers designed for carbonated and non-carbonated beverages, such as beer, softdrinks, juices, etc. Generally they are composed of a metallic shell and an interior sealing liner to retain internal pressure.

Beverage makers promote their products with a closure by differentiating them from the rest and by using the closure for promotional purposes. There are several ways to use crown caps to promote an event.

First, the promotion can be printed under a nondetachable liner. Second, the promotion can be printed under the crown cap liner using an opaque sealing liner that can be detached in order to see the printed item on the crown shell. Third, the sealing liner can be detached together with the printed item. Examples of detachable liners are described in U.S. Pat. No. 6,183,827.

It is also possible for beverage makers to promote their products by printing the upper surface of the closure with regular inks.

It would be desirable to provide a cap closure with color changing characteristics for promotional and novelty purposes, which can be easily printed and provide an added value from the point of view of color effect.

SUMMARY OF THE INVENTION

One embodiment of the present invention provides a metallic closure, which includes:

a metallic shell; and a thermochromic ink layer on a surface of the shell.

Another embodiment of the present invention provides a method for sealing a container opening, which includes contacting the above-mentioned closure with the container opening.

Another embodiment of the present invention provides a method, which includes:

removing the above-mentioned closure from a container sealed with said closure.

Another embodiment of the present invention provides a method, which includes:

detecting a temperature change in the contents of a container, the container being in contact with the above-mentioned closure, by observing a color or color change in the closure.

Another embodiment of the present invention provides an article, which includes:

a container having an opening; and the above-mentioned closure in contact with the container and sealing the opening.

Another embodiment of the present invention provides a method for making the above-mentioned closure, which includes:

contacting the thermochromic ink layer and the shell.

Another embodiment of the present invention provides a metallic closure, which includes:

a metallic shell having a means for fitting over an opening of a container;

a layer means, in contact with the shell, for changing color in response to a change of temperature of said shell.

BRIEF DESCRIPTION OF THE FIGURES

A more complete appreciation of the invention and many of the attendant advantages thereof will be readily obtained as the same becomes better understood by reference to the following detailed description when considered in connection with the accompanying drawings, wherein.

Figure 1:
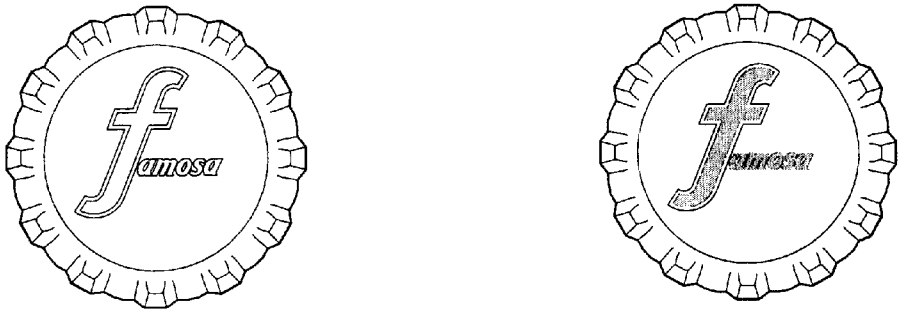
FIG. 1 shows a preferred embodiment of the cap of the present invention.

In the figure, a cap is shown which is printed with conventional and also thermochromic inks. At a first temperature, shown on the left-hand side of the figure, the conventional printing is visible, and the thermochromic ink is either transparent or visible as a first color. At a second temperature, the conventional printing is still visible, and the thermochromic ink is no longer transparent or is visible as a second color different from the first color.

DESCRIPTION OF THE PREFERRED EMBODIMENTS

Various other objects, features and attendant advantages of the present invention will be more fully appreciated as the same becomes better understood from the following detailed description of the preferred embodiments of the invention.

The present invention provides a metallic crown closure that is especially suited for glass or plastic containers designed for carbonated and non-carbonated potable beverages suited for human consumption, such as beer, softdrinks and juices.

Preferably, the present invention thermochromic inks change color over a temperature range of 0–60° C. This range includes all values and subranges therebetween, including 2, 5, 15 10, 15, 18, 20, 22, 23, 24, 25, 30, 35, 40, 45, 50 and 55° C.

The thermochromic ink or dye is not particularly limited, and known or commercial thermochromic inks, dyes and pigments may be used. The color change occurs when the thermochromic ink or dye or pigment reaches a specific temperature. In the context of the present invention, the terms, inks, dyes and pigments are used interchangeably.

The color change is related to temperature changes. Thermochromic inks are formulated to change their color at a specific temperature.

The color change may be in response to internal temperatures of the contents of the container, to external temperatures, or both. The cap may or may not be in physical contact with the contents of the container. Preferably, the cap is in thermal contact with the contents of the container.

Preferable thermochromic materials include thermochromic dyes, such as microencapsulated three-component mixtures of an acid developing substance, an acidic substance and a solvent.

Preferred examples of the acid developing substance include triphenylmethanephthalide compounds, phthalide compounds, phthalan compounds, Acyl Leucomethylene Blue compounds, fluoran compounds, triphenylmethane compounds, diphenylmethane compounds and spiropyran compounds. More preferred examples thereof include 3,3'- dimethoxyfluoran, 3,3'-dibutoxyfluoran, 3-chloro-6-phenylaminofluoran, 3-diethylamino-6-methyl-7-chlorofluoran, 3-diethyl-7,8-benzofluoran, 3,3',3"-tris(p-dimethylaminophenyl)phthalide, 3,3'-bis(p-dimethylaminophenyl)phthalide and 3-diethylamino-7-phenylaminofluoran. Mixtures are possible.

Preferred examples of the acidic substance include 1,2,3-benzotriazoles, phenols and oxy aromatic carboxylic acids. More preferable examples thereof include 5-chlorobenzotriazole, 5-butylbenzotriazole, bisbenzotriazole-5-methane, 5-oxybenzotriazole, phenol, nonylphenol, bisphenol A, bisphenol F, 2,2'-bisphenol, beta-naphthol 1,5-dihydroxynaphthalene, resorcinol, catechol, pyrogallol and phenol resin oligomers.

Preferred examples of the solvent include alcohols, alcohol-acrylonitrile adducts, azomethine and esters. More preferred examples thereof include decyl alcohol, lauryl alcohol, myristyl alcohol, cetyl alcohol, stearyl alcohol, behenyl alcohol, lauryl alcohol-acrylonitrile adducts, myristyl alcohol-acrylonitrile adducts, stearyl alcohol-acrylonitrile adducts, benzylidene-p-toluidine, benzylidene-butylamine, p-methoxybenzylideneaniline, and esters such as octyl caprylate, decyl caprylate, myristyl caprylate, decyl laurate, lauryl laurate, myristyl laurate, decyl myristate, lauryl myristate, cetyl myristate, lauryl palmitate, cetyl palmitate, stearyl palmitate, glycerol monostearate, glycerol monooleate cetyl p-t-butylbenzoate, stearyl 4-methoxybenzoate, dilauryl thiodipropionate dimyristyl thiodipropionate, benzyl thiodipropionbenzoate, distearyl thiodipropionate, benzyltrilaurate benzoate, pentaerythritol tetrastearate and pentaerythritol tetramyristate. Mixtures are possible.

As noted above, the thermochromic dye is preferably microencapsulated. The three-component mixture described above can be microencapsulated by, for example, the following method. A mixture containing at least each of the three components described above is first made molten with heating to yield an oily product. This oily product is added to water containing a surfactant, a protective colloid, a pH regulator, an electrolyte and other substances added as needed, followed by dispersion or emulsification while maintaining an agitation speed such that the grain size of the oil drops becomes 1 to 50 $\mu$m, preferably 2 to 20 $\mu$m. Then, a coat former is added and the oily product is microencapsulated by a known encapsulation method such as the interfacial polymerization method, the insight polymerization method or the coacervation method. The coat former described above may be added in any stage rather than immediately after the grain size adjustment described above or may be added in separate portions.

Preferred coat formers include polymer compounds such as polyurea, polyamide, polyester, polyurethane, epoxy resin, urea resin, melamine resin, gelatin, ethyl cellulose, polystyrene and polyvinyl acetate. Mixtures are possible.

Preferably, the surface of the microcapsule may be coated with a crosslinked initial condensation product of urea resin or melamine resin, epoxy resin, formaldehyde or an isocyanate compound thereby forming a double-coated fine particle.

Preferably, the coat for the microcapsule is a thermosetting resin because of its excellent heat resistance.

Other preferred thermochromic materials are described in U.S. Pat. No. 5,221,288 and U.S. Pat. No. 4,957,949, the entire contents of each of which are hereby incorporated by reference.

Any printing method suitable for metal decoration is applicable. Preferably, the thermochromic ink can be printed on the crown closure in a lithographic process. Most preferably, the thernochromic inks and varnish are applied with rollers on flat sheet during a lithographic process.

The thermochromic crown closure is particularly applicable for promotional features, marketing campaigns or trace and security purposes.

As noted above, in FIG. 1, a cap is shown which is printed with conventional and also thermochromic inks. At a first temperature, shown on the left-hand side of the figure, the conventional printing is visible, and the thermochromic ink is either transparent or visible as a first color. At a second temperature, the conventional printing is still visible, and the thermochromic ink is no longer transparent or is visible as a second color different from the first color. It is clear that many variants of this are possible. One preferred embodiment includes a visible conventional printed layer and a transparent thermochromic layer at a first temperature and a visible thermochromic layer which completely or partially obscures the conventional printed layer at a second temperature, or vice-versa. Several thermochromic inks which change colors or which become transparent at different tempatures may also be printed on a single closure.

Preferably, the present invention includes a crown closure design wherein a covered image is revealed when the temperature changes.

The crown closure is preferably composed with a metallic shell and a plastic sealing liner.

Prior to shell formation, the metallic flat sheet is decorated by means of printing inks and a clear coating in order to protect the image and prevent corrosion. Preferred examples of clear coatings include polyester, epoxy, epoxy ester and acrylic resins and varnishes. Mixtures are possible.

The crown cap of the present invention is printed with a color changing ink capable of changing its color in response to external conditions.

After the metal is decorated with thermochromic inks, it is baked at a temperature range preferably from 150° C. to 190° C. and for preferably 8 to 15 minutes. These ranges independently include all values and subranges therebetween, including 151, 153, 155, 160, 165, 170, 175, 180, 185 and 187° C., and 9, 10, 11, 12, 13 and 14 minutes as appropriate.

The decorating or printing process can include thermochromic, conventional and ultraviolet inks. Clear coating is preferably applied as a top coat on wet or cured inks in order to protect the integrity of them.

Preferred conventional printing inks include alkyd resins.

Preferred ultraviolet inks include acrylated oligomers and polymers such as expoxies, aliphatic urethanes, aromatic urethanes, polyesters and acrylics. Mixtures are possible.

The thermochromic, conventional, and ultraviolet inks may be printed in any sequence and may be printed separately or together. Preferably, there are no protecting layers interposed between the various ink layers.

The thermochromic ink changes its color due to temperature changes within the range from 0° C. to 60° C. The color is reversible between colored and uncolored (or opaque and transparent) states or between a first color and a second color.

The closure may optionally include a liner or detachable liner on the container side of the closure. A transfer ink may be printed on the side of the closure that is in contact with the detachable liner and transfers to the detachable liner from the closure because of a higher affinity to the liner than to the closure. An especially preferred embodiment of the present invention thus includes a metal closure having a thermochromic ink layer on the upper surface thereof and, on a lower surface thereof (and opposite to the upper surface), an epoxy varnish layer, a printed layer that includes a transfer ink made from a polyester resin in contact with the varnish layer, and a polyvinyl chloride resin-containing detachable layer in contact with the printed layer. An especially preferable closure having a detachable liner is described in a concurrently filed, copending U.S. application by the present inventor, identified as attorney docket number 217016US and entitled "Cap Closure and Detachable Liner", the entire contents of which being hereby incorporated by reference.

Having now fully described this invention, it will be apparent to one of ordinary skill in the art that many changes and modifications can be made thereto without departing from the spirit or scope of the invention as set forth herein.

What is claimed is:

1. A metallic crown closure, comprising:

a metallic shell, having an upper and lower surface, wherein said upper surface comprises:

at least one first coating thereon which comprises at least one non-thermochromic printing ink layer, and at least one second coating on said first coating comprising at least one thermochromic ink layer;

wherein said thermochromic ink layer changes from transparent to opaque within a temperature range of 0° C. to 60° C. or wherein said thermochromic ink layer changes from opaque to transparent within a temperature range of 0° C. to 60° C.

2. The closure of claim 1, wherein said second coating further comprises an additional thermochromic ink layer which changes color within a temperature range of 0° C. to 60° C.

3. The closure of claim 1, wherein said thermochromic ink layer undergoes a reversible change in color with changing temperature.

4. The closure of claim 1, further comprising a sealing layer on said lower surface.

5. The closure of claim 1, further comprising a surface that has a shape which corresponds to an opening of a container.

6. The closure of claim 1, wherein said closure is a screw closure.

7. The closure of claim 1, wherein the thermochromic ink layer comprises a plurality of thermochromic inks.

8. The closure of claim 1, further comprising a detachable sealing liner on said lower surface.

9. The closure of claim 8, wherein said liner comprises a polyvinyl chloride resin.

10. The closure of claim 8, further comprising a transfer ink layer interposed between the closure surface and the liner.

11. A method for sealing a container opening, comprising contacting the closure of claim 1 with the container opening.

12. A method, comprising:

removing the closure of claim 1 from a container sealed with said closure.

13. A method, comprising:

detecting a temperature change in the contents of a container, said container being in contact with the closure of claim 1, by observing a color or color change in said closure.

14. An article, comprising:

a container having an opening; and the closure of claim 1 in contact with said container and sealing said opening.

15. A method for making the closure of claim 1, comprising:

contacting said non-thermochromic printing ink layer with said upper surface; and contacting said thermochromic ink layer with said non-thermochromic printing ink layer.

16. The closure of claim 1, wherein said first coating further comprises at least one clear coat.

17. The closure of claim 1, wherein said second coating further comprises at least one clear coat.

18. The closure of claim 1, wherein said first coating further comprises at least one coating selected from the group consisting of polyester, epoxy, epoxy ester, acrylic resin, varnish, and combinations thereof.

19. The closure of claim 1, wherein the non-thermochromic printing ink layer is an alkyd resin.

* * * * *